US009833076B2

(12) United States Patent
Walker et al.

(10) Patent No.: US 9,833,076 B2
(45) Date of Patent: Dec. 5, 2017

(54) HUMAN BALANCE WORK STOOL

(71) Applicant: Herman Miller, Inc., Zeeland, MI (US)

(72) Inventors: Brock Walker, Okemos, MI (US); Mark Goetz, Brooklyn, NY (US)

(73) Assignee: Herman Miller, Inc., Zeeland, MI (US)

( * ) Notice: Subject to any disclaimer, the term of this patent is extended or adjusted under 35 U.S.C. 154(b) by 258 days.

(21) Appl. No.: 14/856,054

(22) Filed: Sep. 16, 2015

(65) Prior Publication Data

US 2016/0073786 A1 Mar. 17, 2016

Related U.S. Application Data

(60) Provisional application No. 62/050,836, filed on Sep. 16, 2014, provisional application No. 62/172,584, filed on Jun. 8, 2015.

(51) Int. Cl.

| | |
|---|---|
| ***A47C 7/00*** | (2006.01) |
| ***A47C 9/00*** | (2006.01) |
| ***A47C 9/02*** | (2006.01) |
| ***A47C 7/56*** | (2006.01) |

(52) U.S. Cl.

CPC ..... *A47C 7/563* (2013.01); *A47C 7/004* (2013.01); *A47C 7/006* (2013.01); *A47C 9/002* (2013.01); *A47C 9/005* (2013.01); *A47C 9/025* (2013.01)

(58) Field of Classification Search

CPC ..... A47C 9/00; A47C 9/002; A47C 9/005; A47C 9/02; A47C 9/025; A47C 9/027; A47C 9/10; A47C 7/004; A47C 7/002; A47C 7/006; A47C 7/008

See application file for complete search history.

(56) References Cited

U.S. PATENT DOCUMENTS

| | | | | |
|---|---|---|---|---|
| 282,371 A * | 7/1883 | Rintelman | ..... | A47C 9/00 108/128 |
| 476,805 A * | 6/1892 | Mason | ..... | A47C 9/00 108/128 |
| 517,929 A * | 4/1894 | March | ..... | A47C 9/00 108/128 |
| 3,480,249 A | 11/1969 | Lie | | |
| 4,099,697 A | 7/1978 | Schuckmann | | |
| 4,131,260 A | 12/1978 | Ambasz | | |

(Continued)

FOREIGN PATENT DOCUMENTS

| | | |
|---|---|---|
| CA | 1039638 A | 10/1978 |
| GB | 2167947 A | 6/1986 |

(Continued)

OTHER PUBLICATIONS

"Office Chair Mechanisms—Swivel, Tilt, Manual, Gas," accessed from www.businessfurnitureshop.com/swivel-chair-mechanisms.html, accessed on Aug. 17, 2015, 3 pages.

*Primary Examiner* — Timothy J Brindley

(74) *Attorney, Agent, or Firm* — Michael Best & Friedrich LLP

(57) ABSTRACT

Novel sit-stand seating devices, more particularly, to sit-stand seats or stools that can tilt forward to provide balanced support for seated to near-standing postures and methods of their use are disclosed. The sit-stand devices are useful, inter alia, to provide stabilized worker positioning to carry out a task for a range of sitting through standing postures in an environment associated with a task for a worker in need thereof.

16 Claims, 11 Drawing Sheets

(56) References Cited

U.S. PATENT DOCUMENTS

| | | | | |
|---|---|---|---|---|
| 4,183,579 | A | 1/1980 | Gonzalez y. Rojas | |
| 4,575,151 | A | 3/1986 | Edstrom | |
| 4,718,726 | A | 1/1988 | Estkowski et al. | |
| 4,765,684 | A * | 8/1988 | Kvalheim | A47C 13/00 297/313 |
| 4,872,727 | A | 10/1989 | Rye | |
| 4,932,719 | A | 6/1990 | Gonzalez y. Rojas | |
| 6,206,335 | B1 | 3/2001 | Huber et al. | |
| 6,945,602 | B2 | 9/2005 | Fookes et al. | |
| 7,207,629 | B2 | 4/2007 | Goetz et al. | |
| 7,478,878 | B2 | 1/2009 | Oettinger | |
| 7,500,718 | B2 | 3/2009 | Fookes | |
| 7,547,067 | B2 | 6/2009 | Keilhauer | |
| 7,841,666 | B2 | 11/2010 | Schmitz et al. | |
| 7,878,591 | B2 | 2/2011 | Walker et al. | |
| 8,066,624 | B1 * | 11/2011 | Stroup | A47C 7/004 297/338 |
| 8,540,314 | B2 | 9/2013 | Fernandez | |
| 8,888,181 | B2 | 11/2014 | Perraut et al. | |
| 8,944,507 | B2 | 2/2015 | Goetz | |
| 2006/0175884 | A1 * | 8/2006 | Jenkins | A47C 3/026 297/300.4 |
| 2009/0140567 | A1 * | 6/2009 | Weiss | A47C 7/503 297/423.12 |
| 2011/0175414 | A1 | 7/2011 | Asbjornsen | |
| 2012/0304370 | A1 | 12/2012 | Gianfagna et al. | |
| 2013/0306831 | A1 | 11/2013 | Keen et al. | |
| 2016/0157618 | A1 * | 6/2016 | Arnett | A47C 9/002 297/174 R |
| 2017/0007026 | A1 * | 1/2017 | Avery | A47C 9/105 |

FOREIGN PATENT DOCUMENTS

| | | | |
|---|---|---|---|
| JP | 6452536 | A | 2/1989 |
| WO | 2014179815 | A1 | 11/2014 |

* cited by examiner

HUMAN BALANCE WORK STOOL

CROSS REFERENCE TO RELATED APPLICATIONS

The present application claims benefit of priority thereto under 35 U.S.C. Section 119(a-d) to U.S. Provisional Application No. 62/050,836 filed Sep. 16, 2014, and U.S. Provisional Application No. 62/172,584 filed Jun. 8, 2015, the disclosures of which are each hereby incorporated herein by reference in their entireties.

FIELD OF THE INVENTION

This invention relates to the field of seating devices, more particularly to sit-stand seats or stools that can tilt forward to provide balanced support for seated to near-standing postures.

BACKGROUND

Prior Art Sit—Stand Devices

Today, 85% of the world's work force sits down when they arrive at work. 70% of US workers sit for 8 hours per day. More surprisingly, 21% sit for 12 hours or more per day. As work time associated with sitting has climbed so has the incidence of back pain and related maladies. There are 91 million back pain sufferers in the US alone and the number of repetitive strain injuries (RSI) has increased dramatically, generally attributable to the duration of time that a worker is seated. Medical science and occupational health studies have demonstrated an irrefutable link between sitting and back pain.

Modern workplace environments and work stations, as well as the demands for mobility and body positioning are vastly changed from earlier workplaces, where chairs provided some back support for desk workers in typically upright seating postures. Modern workplaces require a continuum of stabilized worker positions from seated to standing, while allowing user mobility and range of motion to facilitate job tasks without creating undue muscular strains. Upper body forward leaning positions are typical for modern workers, whether seated or standing, a position that further removes the back and pelvis from any chair support that might be present. A workplace alternative to chairs is stools. But while stools provide more workplace mobility for workers, they lack even the modicum of back support provided by typical chairs. Prior art sit-stand chairs attempted to bridge the gap between stools and chairs, but in doing so, adversely compromised the better aspects of both without really addressing the need for support and mobility throughout a range of sitting/standing postures which a worker may employ during a day at work.

Most industrial sit-stand stool/chairs on the market are slightly modified office chairs with seat/back structures originally designed for office seating, or are specialty sit-stand stools incorporating specific features for a particular application. At present, none of them have been designed for forward oriented tasks requiring a broad range of motions. Years of observation reveal that many workers avoid using a sit-stand-stool/chair soon after it is purchased.

Current products lack proper support resulting in a rearward tilt of the pelvis and spinal kyphosis. And many times, the sit-stand device user's posture against the device causes it to slip and slide rearward. Prior art devices further lack sacral-pelvic support, which can deny the worker access to large muscle groups while employing the device, thereby severely limiting the user's strength at task and for anatomical stabilization and support during task performance.

FIG. 1 illustrates a prior art, sitting and standing chair 100 having a plurality of caster wheels 20 secured to the bottom of support member 10, a floor plate 30 secured to one side of support member 10, a seat rest 40 secured to the top of support member 10, a back rest 50, leg rest 60 and a foot rest 65. The floor plate is attached to one side of the support member with a hinge to be folded downward to rest on the ground when the chair is used for standing. The floor plate is folded upward when the chair is used for sitting for being moved. The back rest is similarly attached to the support member so that it faces the seat rest when the chair is used for sitting and pivoted away from the seat rest when the chair is used for standing. The floor plate prevents the chair from moving while an individual leans against the leg rest and/or back rest while standing. Among the drawbacks, are the chair's lack of mobility for a standing user, its inability to remain at location while a user sits in it, and/or a lack of lower back or sacral/pelvic support in any work position.

FIG. 2 illustrates a seating device 10 comprising a connecting element 12, a supporting element 14 connected to a seat 16 and pivotably connected to the connecting element. The connecting element 12 has an end portion 22 dimensioned to be releasably and rotatably inserted into an aperture defined in a ground or floor. The aperture is dimensioned to receive the connecting element so as to support the seating device. The seating device also comprises a supporting element connected to a seat 16. Moreover, at least one of the connecting element and supporting element comprises at least one stop that permit the supporting element to pivot between a first position whereat the supporting element is in a substantially vertical position, and a second position whereat the supporting element is forwardly inclined of 30 degrees or less with respect to the first position. Such a device is said to be useful for persons who need to stabilize their posture while performing a task. At a minimum, however, the device lacks locational mobility during any use, and/or it lacks lower back or sacral/pelvic support in any work position.

Drawbacks of Prior Art Counterbalance Valves

Although sitting/standing chairs have certain desirable qualities in use for providing support and comfort, they also have drawbacks. These chairs typically choose between vertical height adjustment and forward/rear tilt of the chair support axis. Prior art chairs must also prioritize either locational mobility or structural stability against the other. In the end, this leads to devices that are incapable of versatility in end use in tandem with providing the kind of anatomical support necessary for user comfort and efficiency. Prior art devices typically transfer weight of the user from the vertical support element directly to the floor, which reduces overall user balance and seat stability. These drawbacks, alone or in combination, can ultimately result in worker avoidance of a chair initially perceived to offer improvements to their on-the-job productivity.

As a result, there is a real need for devices that provide a continuum of stabilized worker positions for a range of sitting through standing postures to which a worker is exposed in today's workplace environments. Workers also desire seating devices that allow user mobility and range of motion to facilitate job tasks without creating undue muscular strains. Devices are needed that are stable in use, but are portable so that they can easily travel with the worker to another task location. Seats that not only allow the user to lean forward in a variety of positions, while also providing adequate sacral/pelvic support throughout the entire range of sitting through standing postures, and/or reducing back pain, repetitive strain injuries and/or other occupational health problems are also needed. Seats that provide comfort and performance in sitting or standing positions are highly desirable. The invention is directed to these and other important ends.

BRIEF SUMMARY

One or more of the preceding drawbacks of currently available sit-stand seats are improved, and an advance is made in the art by a novel sit-stand device. According to one aspect of the present invention, a sit-stand device is provided that nests the pelvis and facilitates strong spinal posture regardless of the sitting or standing position desired.

According to yet another aspect of the present invention, sit-stand device is provided that targets sacral support. In certain preferred embodiments, the support is pivotably attached to or embedded within the seat, such that it pivots about a horizontal axis to provide sacral support that adapts to the worker's selected sit-stand position.

According to another aspect of the present invention, sit-stand device is provided that has a wide range of height travel, enabling the user to accommodate a variety of applications from, for example, a standard desk to a tall counter.

According to another aspect of the present invention, a sit-stand device is provided that is portable, enabling facile relocation, while being highly secure to locational movement and steady while in use.

According to another aspect of the present invention, a sit-stand device is provided that enhances range of motion, balance, coordination and body control in use.

According to yet another aspect of the present invention, the sit-stand device reduces discomfort, muscular skeletal strain and fatigue.

According to yet another aspect of the present invention, the sit-stand device is adjustable along a continuum of heights from seated to standing position.

According to another aspect of the invention, the sit-stand device includes a pneumatic seat post component that is suspended within the structural framework of the device.

Advantages of herein disclosed sit-stand devices over existing sit-stand devices may include their adjustability, seat design, portability, stability in use, sacral/pelvic support, resulting in higher overall comfort, improved spinal posture, and/or increased productivity.

DETAILED DESCRIPTION

Figure 1:
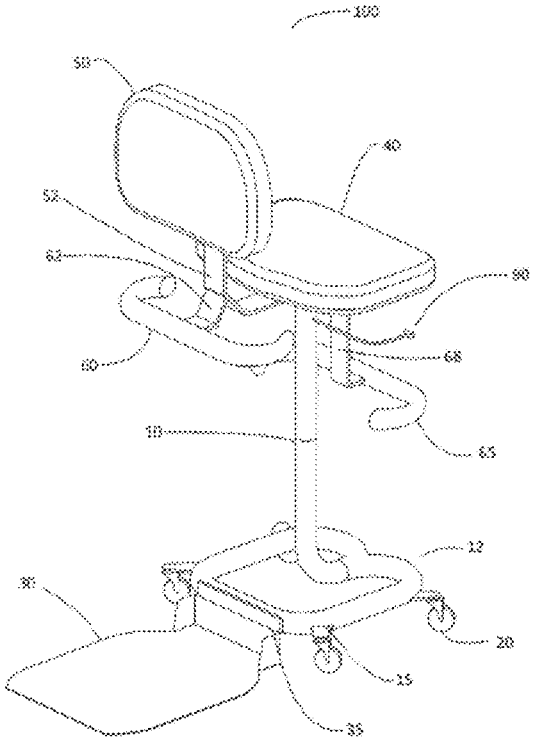
FIG. 1 illustrates a rear perspective view of a prior art seat that converts from a chair to a stand device.
Figure 2:
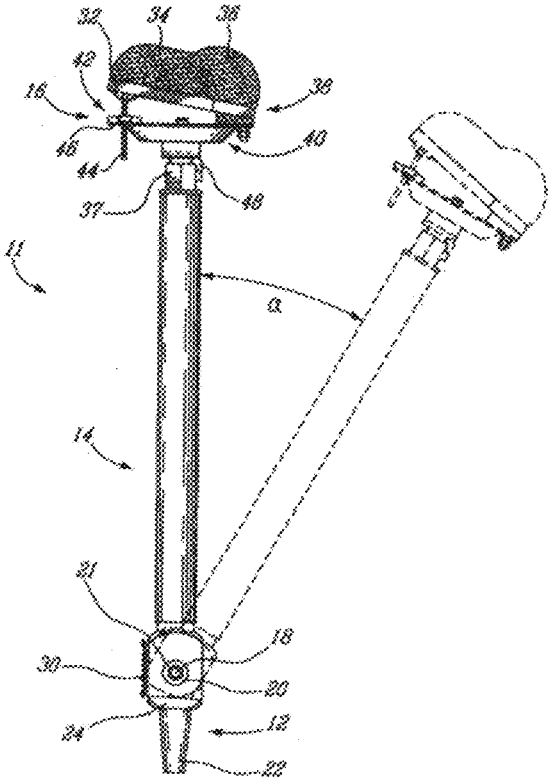
FIG. 2 illustrates a side view of a prior art, forward tilt adjustable sit-stand device.

The following detailed description and the appended drawings describe and illustrate exemplary embodiments of the invention solely for the purpose of enabling one of ordinary skill in the relevant art to make and use the invention. As such, the detailed description and illustration of these embodiments are purely exemplary in nature and are in no way intended to limit the scope of the invention, or its protection, in any manner. It should also be understood that the drawings may not be to scale and in certain instances details have been omitted, which are not necessary for an understanding of the present invention, such as conventional details of fabrication and assembly.

Definitions

ELEMENTS LIST

1 Sit Stand Device
2 Base with Four Legs
3 Seat
4 Seat Post
5 Lower Seat Post Supporting Member
6 Upper Seat Post Supporting Member
7 Connecting Member
8 Leg Extension Member
9 Caster
10 Rearward Tilt Stop
11 Forward Tilt Stop
**12*a*** Lower Pivot for Base/Leg Extension Member
**12*b*** Upper Pivot for Leg Extension Member/Upper Seat Post Supporting Member
**13*a*** Lower Pivot for Seat Post/Lower Seat Post Supporting Member
**13*b*** Upper Pivot for Seat Post/Upper Seat Post Supporting Member
**14*a*** Lower Pivot for Base/Connecting Member
**14*b*** Upper Pivot for Connecting Member/Upper Seat Post Supporting Member

15 Adjustable Foot Rest
16 Sacral Support Member
17 Seat Adjustment Lever The present invention is generally directed to seating devices, more particularly to sit-stand seating devices that are readily height adjustable to accommodate a continuum of ranges of work surface elevations from typical desk top heights to those of standing desks. The seating devices provide excellent posture support for a user throughout this range, and are capable of tilting forward toward the work area while maintaining support for the lower back and/or sacral/pelvic region, ultimately reducing fatigue while improving seat stability, user range of motion, comfort and overall task efficiency.

In certain embodiments of the present invention, adjustable sit-stand devices are provided that may be made of aluminum, wood, metal alloys or composites that preferably reduce overall weight of the device and facilitate portability of the device. When optionally further comprising a plurality of spring loaded casters that support the unloaded device, the sit-stand device requires very little effort by the user to relocate the unloaded device, such as a light pull or push. When the user sits on the device, the caster springs compress to allow the legs and base to create a very stable, support structure for the seat, while maintaining the desired location relative to the work space. In some preferred embodiments, the device includes three casters, spaced substantially equidistant from each other, which enhances the ease of mobility of the device. While three point designs, such as in stools, are prone to toppling, the lower center of gravity in certain embodiments of the present invention reduces the potential for toppling when the present devices are relocated. The spring loaded feature of the casters ensures that when the device is in use, it relies on the much more stable four leg design to provide a steady seating device in use.

In other embodiments, the invention as disclosed provides seating devices, more particularly to sit-stand seats wherein the seat post is suspended within the structure, allowing the force associated with the user's weight to be more evenly distributed over the base and legs.

In still other embodiments, the invention as disclosed provides sit-stand devices wherein the seat provides sacral and/or pelvic region support.

In certain embodiments, the invention as disclosed provides sit-stand devices with seats that are forward tilt adjustable, so as to be capable of maintaining the seat pan portion of the seat in a more horizontal plane while the seat/seat post is tilted in a forward direction.

In other embodiments, the invention provides sit-stand devices that, after use in a tilted forward position in use, return to a more vertical position after the user removes himself from the device.

In still other embodiments, the invention provides sit-stand devices that employ a pneumatic seat post capable of absorbing some of the load and/or facilitating height adjustment for the seat.

Exemplary Embodiments

Figure 3:
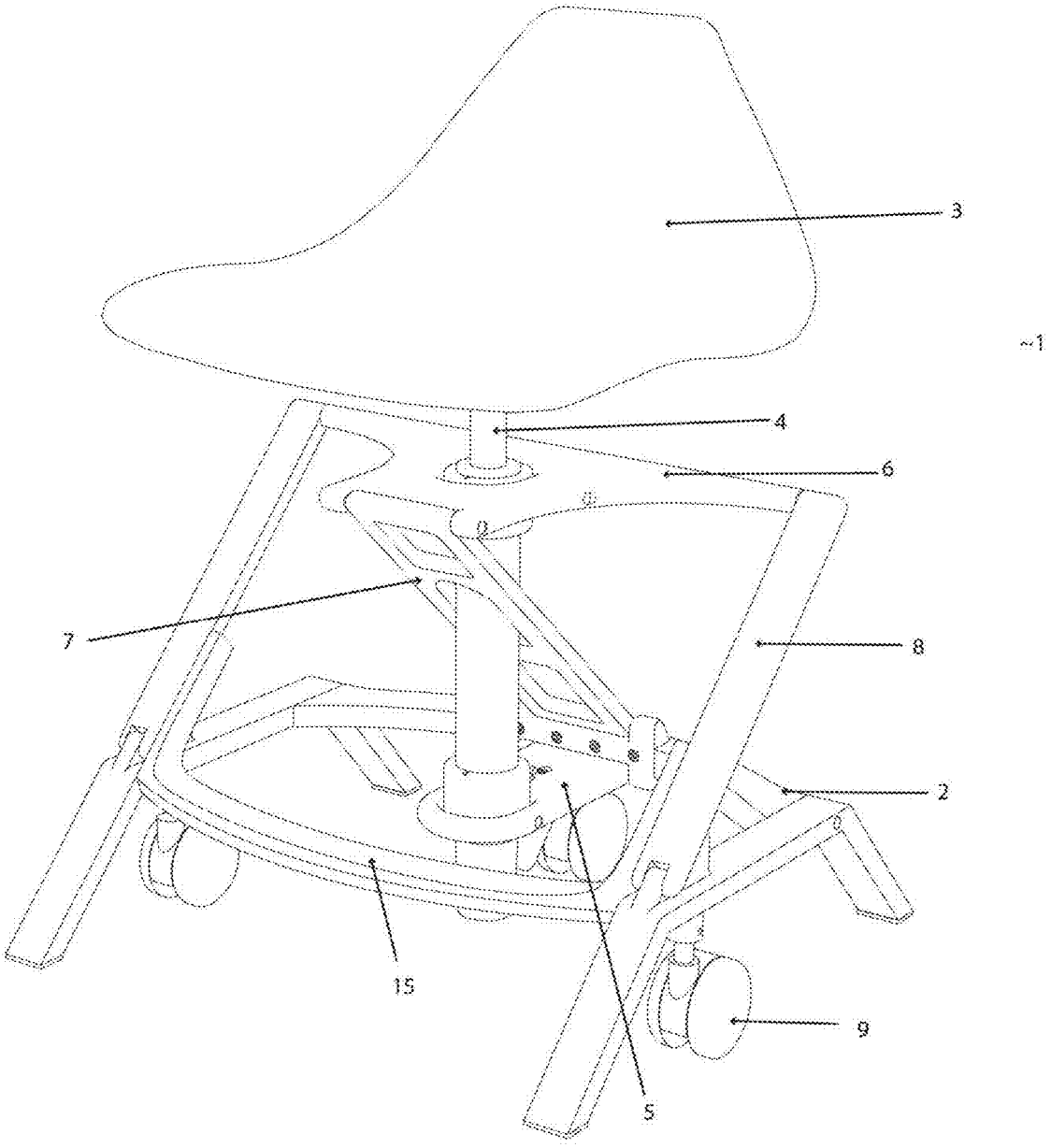
FIG. 3 illustrates a front perspective view of an embodiment of a device according to the present invention.

Referring to the drawings, FIG. 3 depicts an illustrative front perspective of an embodiment of a sit-stand device according to the present invention. Sit-stand device 1 is provided with a base 2 having four legs; a seat 3; a seat post 4; a lower seat post supporting member 5; an upper seat post supporting member 6; a connecting member 7; two leg extension members 8; and three casters 9. The seat post is adjustable to a range of working heights to meet the needs of the user's workplace environment. As illustrated, the seat post in the FIG. 3 embodiment has pneumatic features to assist with seat height adjustments. The seat post is pivotably attached to the upper seat post supporting member from side to side, wherein the pivot's axis is in the plane of the upper seat post supporting member. It is also pivotably attached to the lower seat post supporting member from side to side, wherein the pivot's axis is in the plane of the lower seat post supporting member. The seat post is nested into lower seat post supporting member 5 such that the lower end of the seat post does not come into direct contact with the floor. This facilitates movement of the device when it is unloaded, while allowing the seat post to tilt forward, as needed, when influenced by a user's weight shift. A connecting member 7 is pivotably attached to a frontal portion of upper seat post supporting member 6, and also pivotably attached to a rearward portion of the base. The connecting member defines an opening through which the seat post passes. Upper seat post supporting member 6 is pivotably attached to an upper portion of each of the two leg extension members 8. A lower portion of each leg extension member is also pivotably attached to a forward or frontal portion of the base. The figure also depicts a foot rest 15, preferably adjustable, to accommodate the feet at various height and tilt levels of the device.

Figure 4:
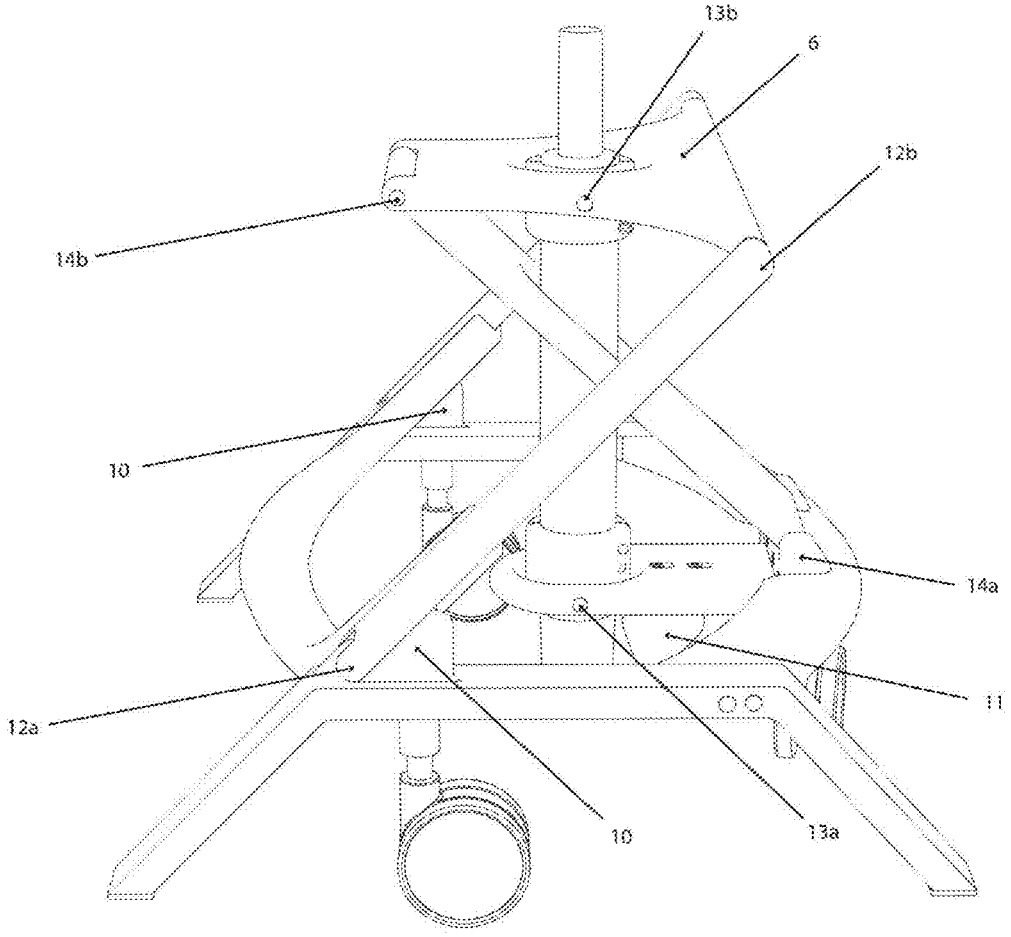
FIG. 4 illustrates a side perspective view of an embodiment of a device according to the present invention and illustrated in FIG. 3.

FIG. 4 depicts a side-on perspective of the embodiment of FIG. 3 according to the present invention. FIG. 4 illustrates two rearward tilt stops 10 configured to limit the rearward pivot of the leg extensions, and a forward tilt stop 11 configured to restrict forward tilt of the seat/seat post. Pivot locations for the two leg extensions (12*a*, 12*b*), the seat post (13*a*, 13*b*) and the connecting member (14*a*, 14*b*) with elements of the device as described above are also indicated.

Figure 7:
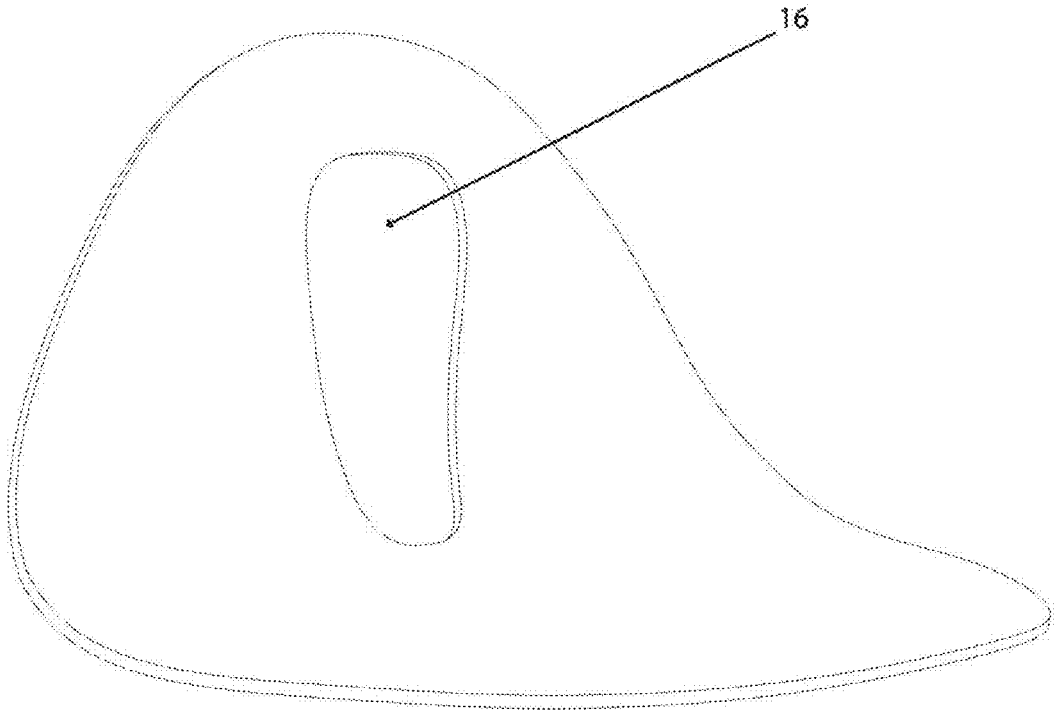
FIG. 7 illustrates an embodiment of a seat element having embedded sacral support moiety for an embodiment according to a device of the present invention.
Figure 8:
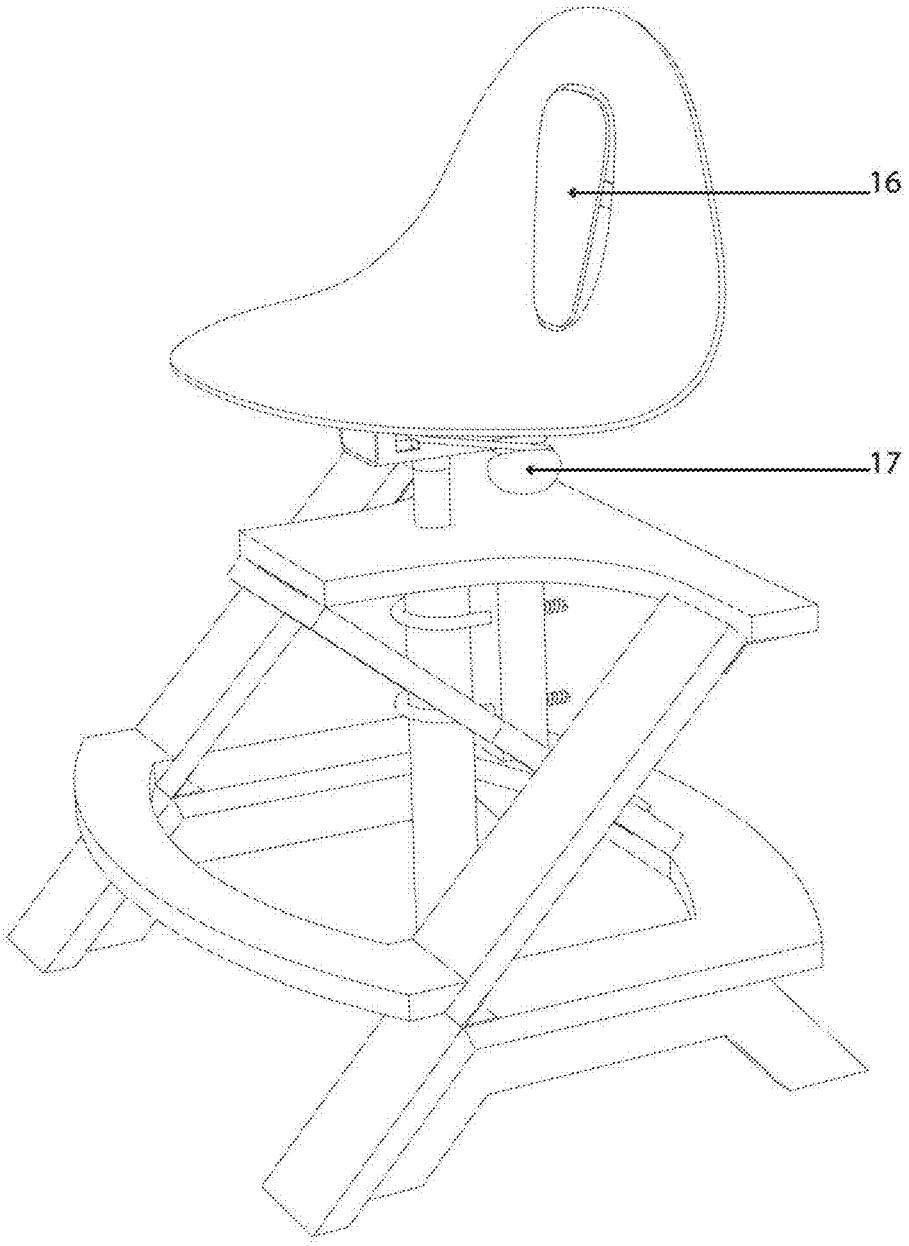
FIG. 8 illustrates a side view of a wood prototype of a device according to the present invention.
Figure 9:
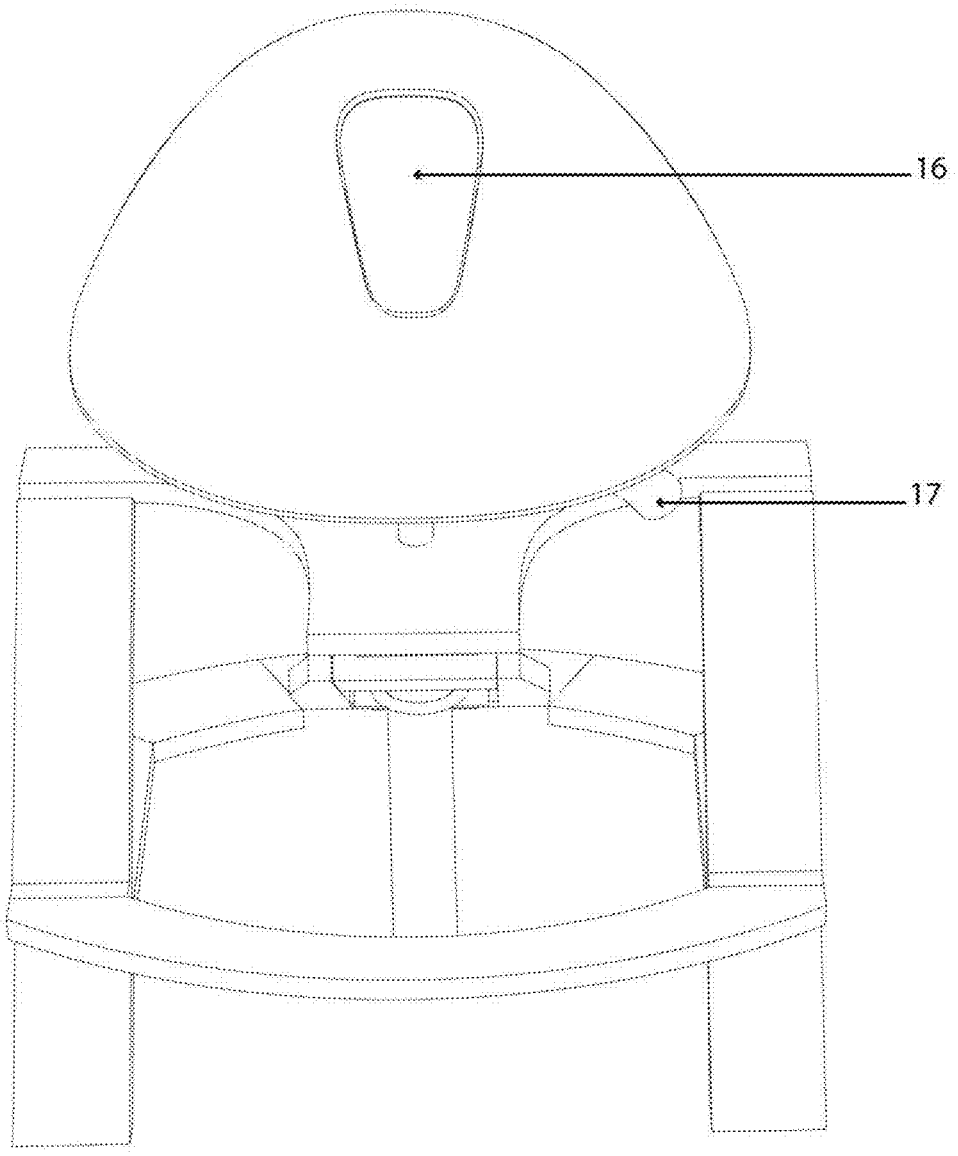
FIG. 9 illustrates a front on view of a wood prototype of the device according to the present invention shown in FIG. 8.
Figure 10:
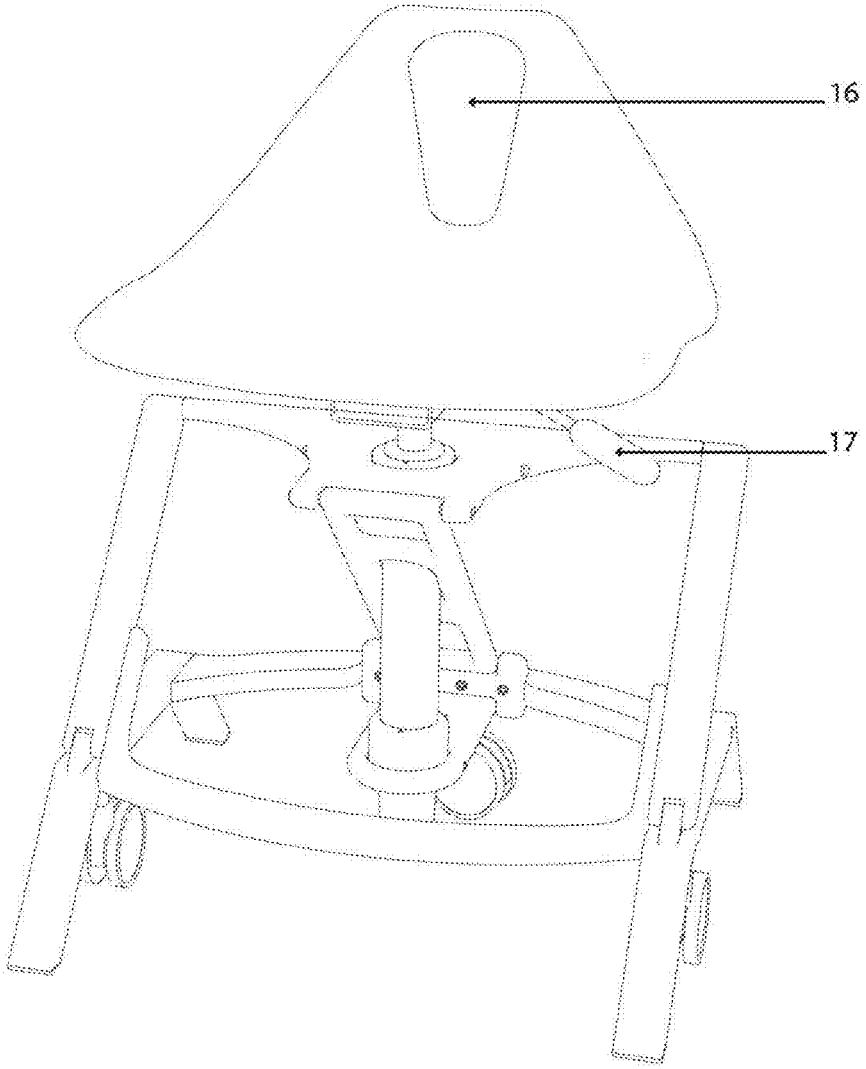
FIG. 10 illustrates a side perspective view of an alternative embodiment of the present invention having an integrated sacral support in the seat.

The seat's materials of construction are not critical and may be made of any material with sufficient strength and capable of being shaped or molded into a desired form or contour, and may be optionally padded for comfort. Typically the seat will comprise a seat pan and seat back, preferably as a continuous element, wherein the seat back or seat back portion of the seat extends sufficiently upward to support at least the sacrum and/or pelvic region. Additional sacral support elements 16 may be embedded (FIG. 7), attached to (See FIGS. 8 and 9) or integrated (See FIG. 10) into the overall seat design. Sacral support elements may also be capable of a front to back adjustment, for example. In one embodiment, the base of the sacral support member may be pivotably attached to the seat, preferably seat back along a horizontal axis such as that shown in FIGS. 8 and 9. In another embodiment of the invention, the sacral support member substantially rectangular, preferably substantially trapezoidal in shape, wherein the sides of the rectangle or trapezoid are longer than its top and bottom. In embodiments where the sacral support member is substantially trapezoidal, the top side is longer than the bottom. A lever or other means of height control may be used to facilitate any height adjustment of the seat post, and may be conveniently located, for example, under the seat pan. A lever may also be employed to manually modify the seat plane into and out of horizontal, based on the needs of the user. Also contemplated is an element that maintains the plane of the seat pan as set by the user, independently of subsequent changes in tilt of the sit-stand device.

In certain embodiments, the device further includes an element which gently resists forward tilt of the seat, allowing the user to better control forward and rearward tilt changes to the seat and seat post. As an illustrative example, the pivot point (FIG. 4, element 12*b*) between one of the leg extension members and upper seat post supporting member may include a square torsion spring, preferably square-in-section, (inserted into an arm portion of the upper seat post supporting member), which biases the device in a upright position when unloaded, that stores energy during forward tilt to dampen movement and further control the response of the seat to weight shift. The spring is capable of later releasing this energy upon load release to assist the device in righting itself. Alternatively, an extension spring or compression spring may be employed to provide similar function. The location of these would be obvious to one of ordinary skill in the art, once armed with the disclosures herein.

In other embodiments, the device includes an element capable of moving the seat forward or rearward in response to various degrees of tilt. This element can permit the user to fine tune or perfect his balance atop the seat post, preferably pneumatic, as weight is shifted to modify the tilt of the stool's seat post. The element is preferably slidably attached to the seat post or seat, more preferably having a manual adjustment lever under the seat to assist the user in balancing his weight over the seat post.

Figure 6:
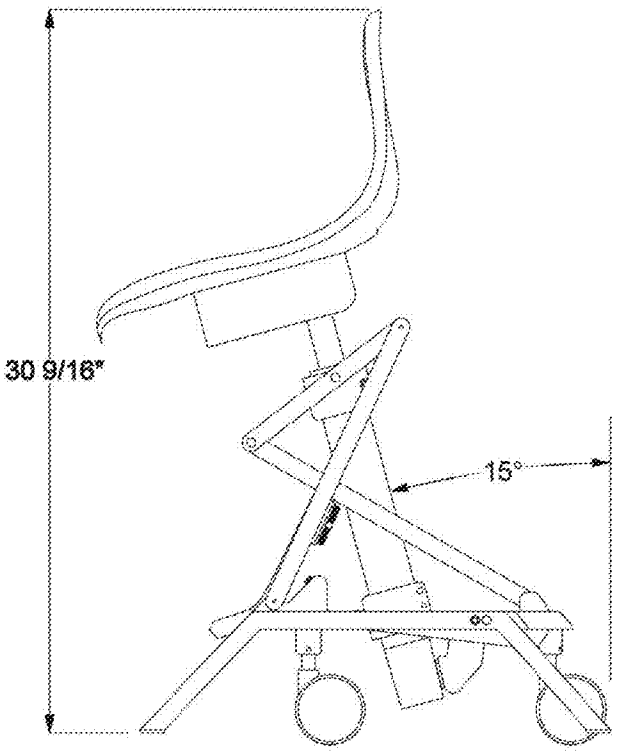
FIG. 6 illustrates a side view of the embodiment according to FIG. 5 shown in a tilt forward position.
Figure 5:
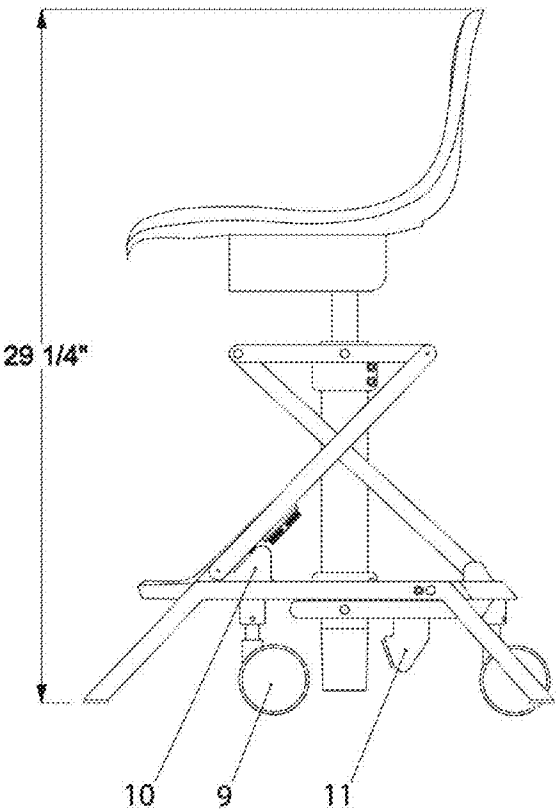
FIG. 5 illustrates a side view of an embodiment according to the present invention shown in a resting upright position with no load (no one seated in it).

Referring to the drawings, FIGS. 5 and 6 depict side views of an illustrative embodiment of a sit-stand device at rest under load (FIG. 5) and in a tilted forward position. In more typical operation when a user sits on the device, springs in the casters compress until the legs come into contact with the floor surface. The rearward tilt stops 10 are in contact with the leg extension members, prohibiting further rearward tilt of the seat post. When a user shifts his weight forward on the device, the seat post pivots forward to allow the worker to more closely approach the work space. The extent of pitch forward allowable is limited by the contacting of the forward tilt stop with a lower portion of the seat post. This forward weight shift causes the leg extensions to pivot forward of and/or away from the rearward tilt stop as shown in FIG. 6. If the user shifts weight toward the rear the device reverses itself under the force applied. When the user gets out of the seat (load is removed), the device assists itself in righting toward the original upright position. The casters' springs also decompress when load is lifted and allow the device to once again become mobile, and may be located simply with a light push of the seat or frame, or a bump from the user's leg.

Figure 11:
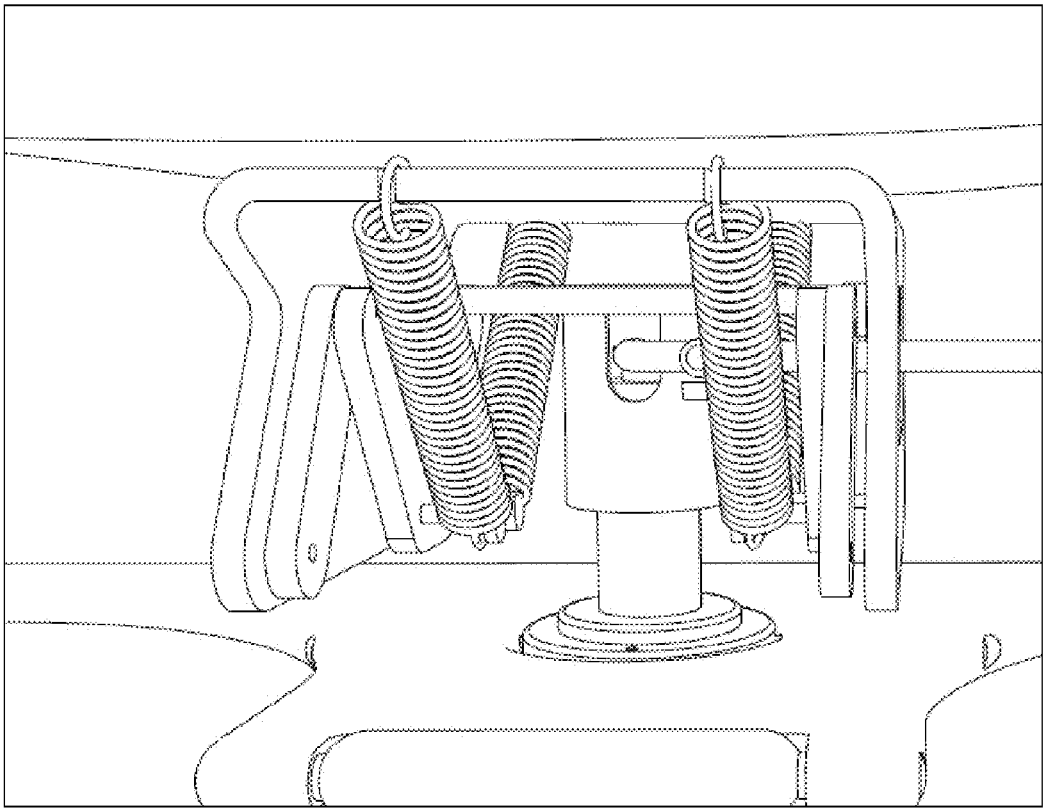
FIG. 11 illustrates a swing mechanism of a metal prototype of a device according to the present invention.

In some embodiments, a swing mechanism may be positioned between the base of the seat (3) and the seat post (4) in the sit stand stool as disclosed herein. An exemplary swing mechanism is shown in FIG. 11. The swing mechanism enables the seat to be moved forward or rearward and thus extend the range of positions attainable by the user. Alternatively, the seat may be pitched forward or rearward due to seat post tilt in a forward leaning or active offload position. In this scenario, the swing mechanism allows movement in a forward and/or rearward swing path and extends the range of motion for the seat and user, without requiring that the sit-stand stool be repositioned relative to a particular workspace.

Figure 13:
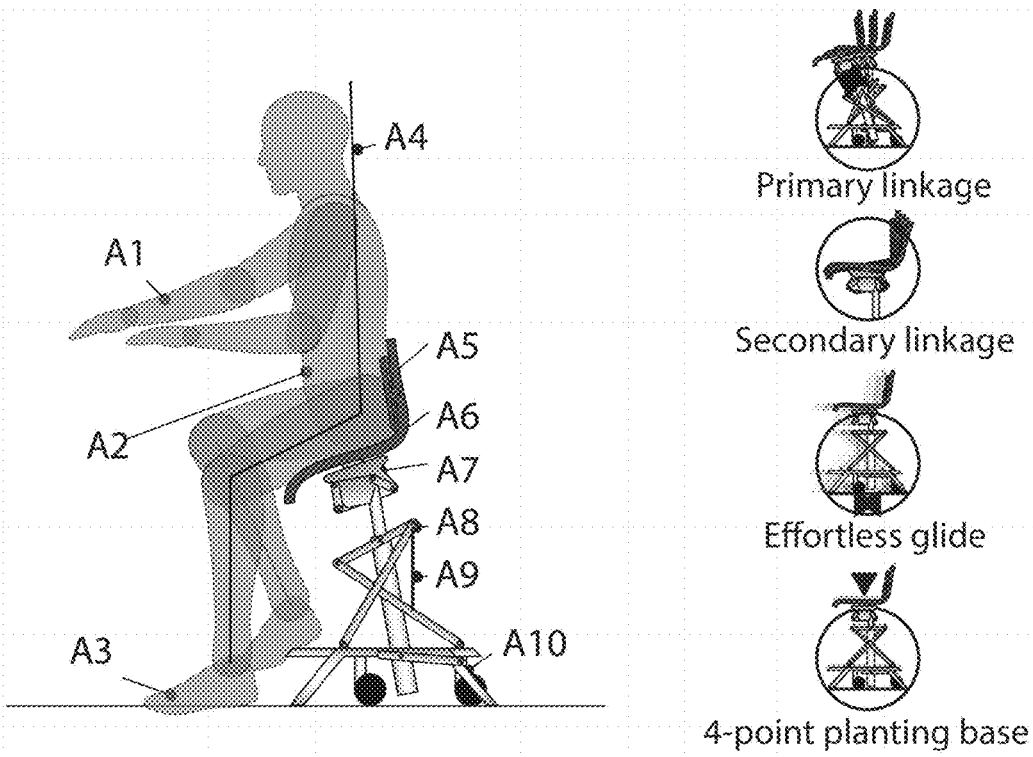
FIG. 13 illustrates a user at a leaning forward actively engaged position while sitting at a desk or work station in a device according to the present invention adjusted to an intermediate seat height, wherein the embodiment further illustrates the swing mechanism between the seat and the seat post.

In certain embodiments, the sit-stand stool as presently disclosed incorporates one or more elastomeric resistance bands to return the still to an upright, neutral position. An exemplary depiction of an elastomeric band is shown in FIG. 13. These bands act to provide confidence to the user in terms of, e.g., positional stability, and improve or enhance user efficiency, leverage and task control for a given task. The elastomeric bands also provide a return force on the seat post tilting mechanism that assists in righting the seat post once the user in no longer in contact with the seat. The elastomeric bands can act alone or in combination with any one or more of square torsion springs, extension springs or compression springs as herein disclosed to better control forward and/or rearward tilt changes in the seat post. Typically, the force provided to the stool by the one or more bands should be moderate in nature, providing at least enough resistance to require the user to tilt the seat post forward and provide the user with dynamic feedback, but less than an amount which would cause undue strain to the user or give rise to a seating imbalance for the user.

FIG. 13 further discloses certain aspects of the innovation incorporated into some embodiments of the present invention. For example, by connecting and empowering the mechanical leverages (A3, A5, A6) between the muscular skeletal system/seat/primary and secondary linkages shown in FIG. 13, the invention closes the muscular-skeletal interdependent loop, i.e., the head, pelvis, feet, and torso are working together (A4). This progression delivers strength (A9), balance (A7, A8), body control (A2) and task control (A1). Mechanical leverage is provided through use of sacral support (A5), a nesting of the pelvis in an anatomically designed contour (A6), as well as foot engagement on the floor or a footrest (A3). Moreover, the base plants firmly on four points to prevent slipping (A10). Strength for use in a task is delivered when the sitter engages core and large muscles to stretch resistance bands in the primary linkage. The primary linkage offers balance in extended range (A8), while the secondary self-balancing linkage allows user to control their pelvic angle (A7). The sum of leverage, balance and strength equates to body control (A2). Once body control is established, task performance is easy (A1). Combination of some or all these features may result in higher performance. Via leverage control, the user can connect and manage the three components of empowerment, i.e., the muscular-skeletal system, the seat and the primary and secondary linkages. Connecting the components of empowerment together joins the upper and lower body together to yield total body participation in a power posture. By acquiring macro muscular skeleton control, micro muscular skeleton control is improved. Together they increase response to task. By acquiring macro muscular skeleton control, micro muscular skeleton control is improved. Together they increase response to task. The combined control of the macro- and micro-muscular skeleton yields empowerment, strength, balance, endurance, and the ability to perform better over long periods of time without injury or discomfort.

The band resistance desired can be changed (increased or decreased) by exchanging the one or more bands with alternative bands having differing elastomeric resistance characteristics, or by adding or removing one or more of a group of such bands to/from the stool. The bands may be attached to the frame which allows for a return force capable of righting the seat post. In exemplary fashion, two elastomeric bands may be attached at one end of a band to the upper seat post supporting member (6) and at the other end of the band to the connecting member (7). In this configuration, the bands are attached to the upper seat post supporting member typically at or near the member's rear edge by any means capable of providing the attachment, preferably such attachment allows for ready individual detachment of any attached band. The other terminus of each band may be attached to the connecting member such that the tension of the bands is sufficient to reduce the angle formed between the plane of the upper seat post supporting member and the plane of the connecting member. Other configurations of elastomeric bands or mechanisms to provide a return force for providing this function would be clear to the ordinarily skilled artisan once armed with the present disclosures.

Figure 12:
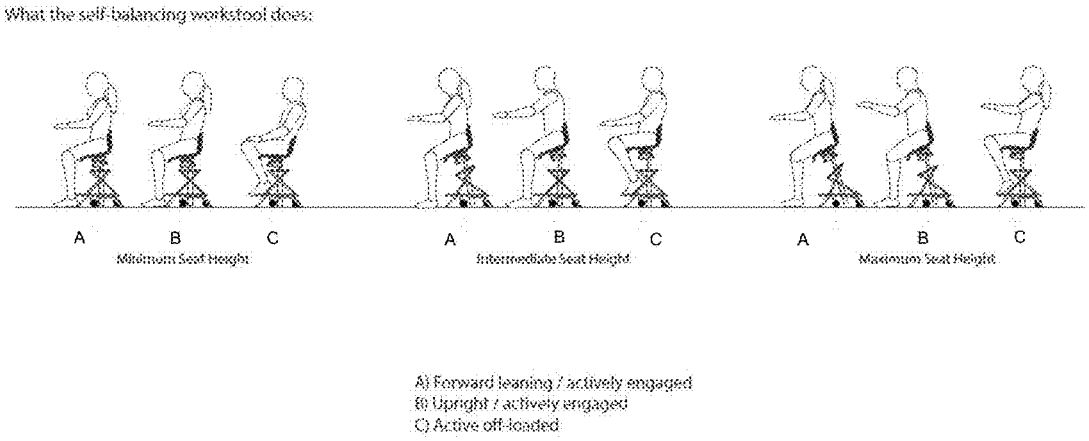
FIG. 12 illustrates the leaning forward and actively engaged, upright and actively engaged, and the active off-loaded exemplary positions for each of the minimum, intermediate and maximum seat heights of a device according to the present invention.

Generally, when operating the sit-stand stool, a user may need to carry out tasks under any number of conditions. However, most tasks will require a condition or position that will typically fall into one of three categories: forward leaning and actively engaged, upright and actively engaged, and active off-loaded. FIG. 12 illustrates each of these categories at minimum, intermediate and maximum seat heights for an embodiment of a device as disclosed herein.

The stool provides a continuum of positions to dynamically adjust postural support to meet the needs of a given task and support for the user necessitated by the task and its operations. By way of example, one can envisage, among this continuum of possible positions for any given seat height defined by a task, at least three positions to assist in a demonstration of the breadth of utility for the stool. First, the stool may be used in a "leaning forward" position, where the stool-supported user is actively engaged, and by use of his muscles and/or body weight shift, has positioned the seatpost forward of vertical to allow closer inspection of the task at hand. In a second position, defined as an "active upright" position, the user has shifted his weight to position the seatpost in a substantially vertical manner while actively engaged in a task. A third position may be described as an "active offload" position. In this position, the user is moderately leaning away from the task, for example, to observe, analyze or reconsider the task being performed.

The three positions, among many others that are contemplated for the stool, are readily accessible with the present sit-stand stool, for such exemplary positionings further defined by seat height as minimum seat height, intermediate seat height, and maximum seat height.

For example, minimum seat height positioning of the sit-stand stool as hereinthroughout disclosed can be used to facilitate doctor-patient examinations by allowing the doctor to lean forward to examine a patient's condition very closely, to carry out other aspects of the examination in a more upright seating position, and to active offload while discussing with a patient his observations and diagnosis of the condition.

In another context, the stool would benefit a musician during play by allowing the musician to study his instrument or the music more closely during certain points in a performance, sit in a more upright position while playing more routine parts of the musical score and allow further freedom of movement to and from an active offload position during more creative or improvisational aspects of play.

For those typically seated at desks for the majority of their tasks, the upright position accommodated by the stool's disclosures attends to most needs, but additionally allows a user to tilt forward to reposition documents on the desk or view a computer screen more closely, while allowing a rest/stretch to disengage from the work project for a short time by shifting the stool into a rest/active offload position.

Workers situated at standing desks or work stations have similar needs for the three positions, each without sacrificing stability, comfort or control. At each instance, the stool as presently disclosed herein provides these necessary features to the user.

Other examples of workspace environments that benefit from the stability and flexibility in use characteristics of the presently described sit-stand tool include: repetitive assembly tasks or assembly line work stations, security guard work stations, and cashier work stations, especially in high volume retail oriented cashier work stations.

In view of the present disclosure, a person of ordinary skill in the art will appreciate that the configuration of the present invention can be altered or adjusted by changing the shapes, pivots, materials of construction, and locations of the elements of the sit-stand device. Therefore, one of ordinary skill in the art will appreciate that the sit-stand device of the present invention can be readily modified to meet a range of needs of a user in modern workplace environments to provide sit-stand device for different applications.

Any other undisclosed or incidental details of the construction or composition of the various elements of the disclosed embodiments of the present invention are not believed to be critical to the achievement of the advantages of the present invention, so long as the elements possess the attributes needed for them to perform as disclosed. Certainly, one of ordinary skill in the mechanical arts would be able to conceive of a wide variety of shapes, pivots, materials of construction, and locations of the elements, as well as successful combinations of the invention disclosed herein. The selection of these and other details of construction are believed to be well within the ability of one of even rudimentary skills in this area, in view of the present disclosure.

Illustrative embodiments of the present invention have been described in considerable detail for the purpose of disclosing the practical, operative structure whereby the invention may be practiced advantageously. The designs described herein are intended to be exemplary only. The novel characteristics and features of the present invention may be incorporated in other structural forms without departing from the spirit and scope of the present invention. The invention encompasses embodiments both comprising and consisting of the elements described with reference to the illustrative embodiments. The invention illustratively disclosed herein suitably may be practiced in the absence of any element which is not specifically disclosed herein. The invention illustratively disclosed herein suitably may also be practiced in the absence of any element which is not specifically disclosed herein and that does not materially affect the basic and novel characteristics of the claimed invention.

Unless otherwise indicated, all ordinary words and terms used herein shall take their customary meaning as defined in *The American Heritage Dictionary*, Third Edition. All technical terms shall take on their ordinary and customary meaning as established by the appropriate technical discipline utilized in that particular art.

What is claimed is:

1. A sit stand device, comprising:

a base having four legs;

a seat comprising a seat pan portion;

a seat post;

a lower seat post supporting member connected to the base;

an upper seat post supporting member;

a connecting member pivotably connected to the base and to the upper seat post supporting member; and two or more leg extension members each pivotably connected to:

the base: and the upper seat post supporting member;

wherein:

the lower seat post supporting member defines an opening for pivotably supporting the seat post;

the upper seat post supporting member defines an opening for pivotably supporting the seat post, and the connecting member defines an opening through which the seat post passes.

2. A sit stand device accordingly to claim 1, wherein the seat further comprises a seat back portion.

3. A sit stand device accordingly to claim 2, wherein the seat pan and seat back are provided as a continuous element.

4. A sit stand device accordingly to claim 2, wherein the seat further comprises a sacral support member.

5. A sit stand device accordingly to claim 4, wherein the sacral support member is pivotably attached to or embedded within the seat.

6. A sit stand device accordingly to claim 5, wherein the sacral support member is pivotably attached to the seat.

7. A sit stand device accordingly to claim 1, wherein the seat post is suspended within the device.

8. A sit stand device accordingly to claim 1, further comprising a plurality of spring loaded casters that support the device when it is unloaded.

9. A sit stand device accordingly to claim 8, wherein the plurality of casters includes three casters spaced substantially equidistant from each other.

10. A sit stand device accordingly to claim 1 capable of maintaining the seat pan portion substantially horizontally while the seat post is tilted in a forward position.

11. A sit stand device accordingly to claim 1, wherein the seat post is pneumatic.

12. A sit stand device accordingly to claim 1, capable of returning itself to a more vertical position after a user removes himself from the device.

13. A sit stand device accordingly to claim 4, wherein the sacral support member has a substantially trapezoidal shape, wherein the trapezoid's sides are longer than either the top side or the bottom side.

14. A sit stand device accordingly to claim 13, wherein the sacral support member's top side is longer than its bottom side.

15. A method of providing stabilized worker positioning for a range of sitting through standing postures comprising:

providing a sit stand device in an environment associated with a task, the sit stand device comprising:

a base having four legs;

a seat comprising a seat pan portion;

a seat post;

a lower seat post supporting member connected to the base;

an upper seat post supporting member;

a connecting member pivotably connected to the base and to the upper seat post supporting member; and two or more leg extension members each pivotably connected to:

the base: and the upper seat post supporting member;

wherein:

the lower seat post supporting member defines an opening for pivotably supporting the seat post;

the upper seat post supporting member defines an opening for pivotably supporting the seat post, and the connecting member defines an opening through which the seat post passes;

sitting in the sit stand device; and adjusting the positioning of one or more elements of the device to stabilize worker positioning for a posture required to carry out the task.

16. A sit stand device, comprising:

a base having four legs;

a seat comprising a seat pan portion, a seat back portion, and a sacral support member, wherein the seat pan and seat back are provided as a continuous element, and the sacral support member is pivotably attached to the seat;

a pneumatic seat post suspended within the device;

a lower seat post supporting member connected to the base;

an upper seat post supporting member;

a connecting member pivotably connected to the base and to the upper seat post supporting member;

three spring-loaded casters spaced substantially equidistant from each other that support the device when it is unloaded; and two or more leg extension members each pivotably connected to:

the base: and the upper seat post supporting member;

wherein:

the lower seat post supporting member defines an opening for pivotably supporting the seat post;

the upper seat post supporting member defines an opening for pivotably supporting the seat post;

the connecting member defines an opening through which the seat post passes;

the device is capable of maintaining the seat pan portion substantially horizontally while the seat post is tilted in a forward position; and the device is capable of returning itself to a more vertical position after a user removes himself from the device.

* * * * *